United States Patent [19]

Parker

[11] Patent Number: 4,940,174

[45] Date of Patent: Jul. 10, 1990

[54] GARMENT SUPPORTING SYSTEM INCLUDING TIE THEREFOR

[76] Inventor: Robert McD. Parker, 51 E. 78th St., New York, N.Y. 10021-0207

[21] Appl. No.: 407,353

[22] Filed: Sep. 14, 1989

[51] Int. Cl.[5] ..... A45F 3/14

[52] U.S. Cl. ..... 224/257; 224/255; 294/141; 223/85

[58] Field of Search ..... 224/259, 255, 257, 258, 224/265, 42.45 A, 42.46 A, 217; 294/141, 142, 143; 223/85, 88, DIG. 4; 211/113, 118

[56] References Cited

U.S. PATENT DOCUMENTS

| | | | |
|---|---|---|---|
| D. 214,145 | 5/1969 | Papineau . | |
| D. 270,884 | 10/1983 | Tavela . | |
| 351,102 | 10/1886 | Flieger . | |
| 1,268,416 | 6/1918 | Wordingham . | |
| 1,689,373 | 10/1928 | Weinberg . | |
| 1,760,739 | 5/1930 | Bolinger . | |
| 1,900,826 | 3/1933 | Lindsay . | |
| 2,072,017 | 2/1937 | Wisneski . | |
| 2,172,681 | 9/1939 | Plaks . | |
| 2,499,188 | 2/1950 | Freeman . | |
| 2,753,093 | 7/1956 | Pick . | |
| 2,977,001 | 3/1961 | Vitale . | |
| 3,270,892 | 9/1966 | Dennis et al. . | |
| 3,373,878 | 3/1968 | Daitch . | |
| 3,528,590 | 9/1970 | Nathanson . | |
| 3,549,065 | 12/1970 | Schubert | 294/143 |
| 3,666,149 | 5/1972 | Woodhull . | |
| 3,759,430 | 9/1973 | Ward | 224/257 |
| 3,848,787 | 11/1974 | Hill | 294/141 |
| 4,153,189 | 5/1979 | Hughes | 224/42.46 A |
| 4,730,863 | 3/1988 | Guadnola | 294/142 |

*Primary Examiner*—Linda J. Sholl

*Attorney, Agent, or Firm*—Morgan & Finnegan

[57] ABSTRACT

There is disclosed a garment supporting system in which a garment hanger having an aperture in the hooklike neck thereof is employed in combination with an elongated flexible tie having a less flexible segment located along its length, a gripping ring located at one end and a ring member at the opposite end to provide a system which permits transport of a plurality of garments in a controlled and facile manner.

17 Claims, 3 Drawing Sheets

FIG. 9
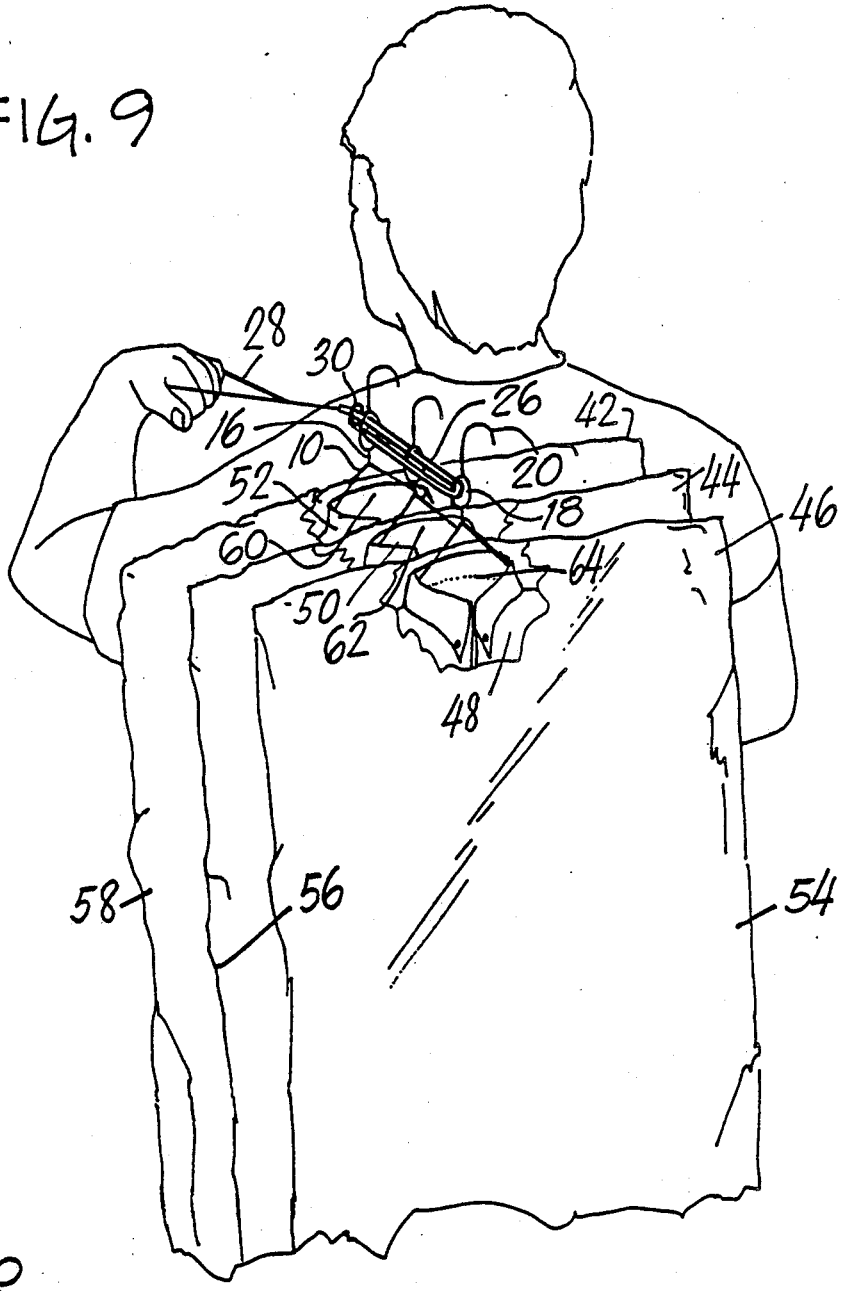
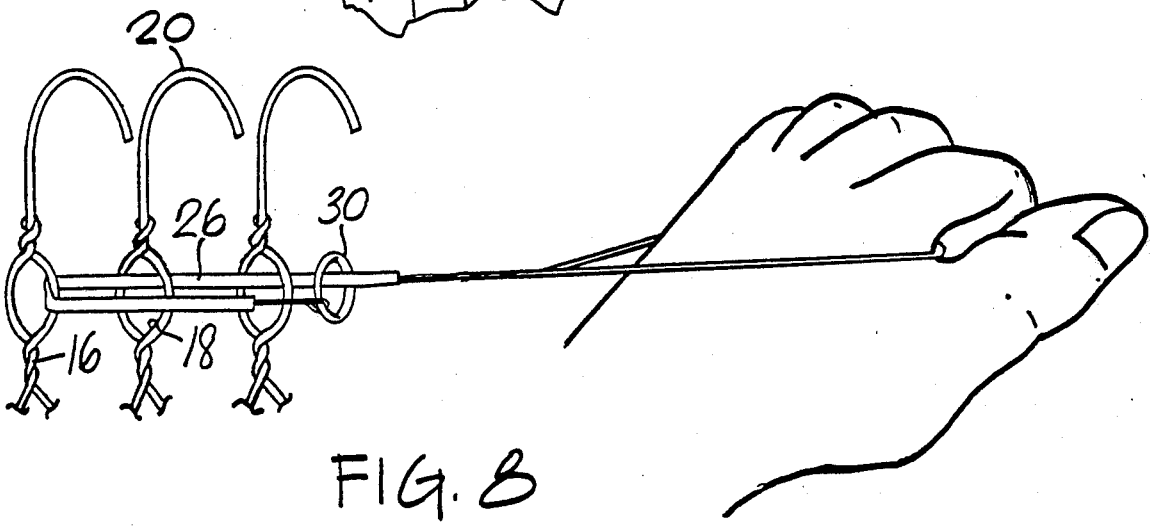
FIG. 8

GARMENT SUPPORTING SYSTEM INCLUDING TIE THEREFOR

This invention relates to a garment supporting system. More particularly, the invention relates to garment supporting systems including a tie therefor in combination with a garment supporting means, such as a garment hanger having aperture in its neck.

BACKGROUND OF THE INVENTION

A wide variety of garment hangers and devices for joining the same together are known. Patents illustrative of such known devices include U.S. Pat. No. 351,102 to Flieger which discloses a pants hanger which includes an eye through which a hook is passed to secure the hanger to, for example, a peg. U.S. Pat. No. 1,268,416 to Wordingham discloses a shirt waist and skirt hanger which includes an opening through which a hook may be engaged. On the other hand, U.S. Pat. No. 1,689,373 to Weinberg discloses a garment hanger having an opening to allow a user to place his fingers therethrough and thereby hold a garment on the hanger without touching and soiling the shoulders of the garment. U.S. Pat. No. 1,760,739 to Bolinger discloses a hanger which includes a spring loop and a support hook adapted to be folded upon the hanger body in order to minimize the amount of space occupied by the hanger.

U.S. Pat. No. 1,900,826 to Lindsay discloses a clothes hanger which includes a clamp to secure the hanger to a line, whereby clothing on the hanger will not be blown together or towards the lower end of the line when a plurality of hangers are disposed on the line.

U.S. Pat. No. 2,072,017 to Wisneski discloses a clothes hanger having an arched shank and a coil which cooperates with the arched shank in order to bind the hanger to the closet rod. U.S. Pat. No. 2,172,681 to Plaks discloses a pattern holder which for the purpose of separation of garments includes a plurality of openings and slots for inserting and retaining pins which may be attached to dress patterns or articles of clothing. U.S. Pat. No. 2,753,093 to Pick discloses a skirt hanger having a shank which includes curved portions which provide arms for the hanger with sufficient resiliency such that they will apply a moderate retaining pressure to a skirt being held thereon.

U.S. Pat. No. 3,666,149 to Woodhull discloses a garment hanger support which includes a spring strip which may be resiliently clasped around a bar.

U.S. Pat. No. D. 214,145 to Papineau and U.S. Pat. No. D. 270,884 to Tavela disclose apertures disposed within the neck of the hanger. On the other hand, U.S. Pat. No. 2,499,188 to Freeman discloses a sorting reel hook which has a garment-hanging portion that includes a plurality of depressions for holding a group of hangers in a spaced relationship to one another. The hook also includes a roller which allows the sorting reel hook to slide along a railing.

U.S. Pat. No. 2,977,001 to Vitale discloses a portable drying rack including a hook for hooking the rack over a rod, a plurality of hanger bar sections and a plurality of spacer rod sections for joining the hangers together.

U.S. Pat. No. 3,270,892 to Dennis et al. discloses a hanger which includes a plurality of openings through which hangers may be placed.

U.S. Pat. No. 3,373,878 to Daitch discloses a coat hanger coupler and assembly, the coupler comprising one or more bars of wire extending through the yoke disposed immediately below the twisted wire connection between the two arms of the hanger and in which one of the central hangers within a group of hangers may be grasped for the purpose of lifting the assembly and while the remaining several hangers remain secured in their proper relationship to one another.

U.S. Pat. No. 3,528,590 to Nathanson discloses a hanger spacing device which has a plurality of apertures and a plurality of slits where the hanger necks may be positioned within the apertures so that it is possible to segregate a group of garments without crushing them.

While the various Patents referred to above admirably accomplish their stated purposes, they present a number of disadvantages. For example, as is well known when a consumer goes to a cleaning establishment to retrieve garments he has left there for cleaning, and/or repairs, the garments are usually disposed on separate garment hangers which are then tied together with each other by a length of tie which is simply twisted at its end around the necks of the plurality. The plurality of hangers is then grasped by the consumer through the hooks for transport to a waiting vehicle and then to the consumer's residence or directly to his residence by foot. When so grouped together, the plurality of hangers, due to the bulk of the garments disposed thereon, is difficult to handle and carry. This is so since, while the twisted tie does perform its function to hold the separate hangers close to each other, it does not alleviate any of the problems of carrying even a small bundle of hanging garments. The position of such a tie, low on the hanger, wrinkles the garments, especially in plurality when the tie must pass under the hooklike "neck" of the hanger and over the clothing collar and again under the hanger "neck" and across the collar of each clothing article, so that the collar of each garment often becomes wrinkled in order to carry a plurality of items. Thus, due to conventional cleaning-establishment and laundry-establishment practices, one of the primary reasons for sending clothes to the cleaners and laundry is completely negated by current methods of transporting a bulk of cleaned and pressed garments.

Furthermore, in accordance with present practices, a bulk of clothes on hangers, bound together in the aforementioned manner, may be transported by hand in a variety of methods, which most often result in the carrier supporting the entire weight of the bundles on two fingers, i.e., the index and second fingers. This method of carrying proves very quickly to become tiresome as one's arm must constantly lift the garments upward to counteract the natural forces of gravity, and, because of the concentrated weight bearing upon the two fingers, one must frequently change the position in which the bundle is carried. Often the carrier must resort, still using the two-finger method as predicated by the size of the hook of conventional clothes hangers, to sling the clothes across his back, thereby folding the pressed garments into a position which the hanger rests perpendicularly on the shoulder, thus creasing the garments at practically a ninety-degree angle. Consequently, even if the bundle is resting upon the carrier's back, the usually employed slippery plastic covering often causes the bulk of garments to slide across the back or shoulder and by the time the consumer has arrived home with his clothing, both are the worse for wear. Clearly, current methods of carrying a bundle of clothing are ineffective and needlessly burdensome.

There exists, therefore, a need for a garment supporting system that does not exhibit the above-mentioned disadvantages and allows a person to carry a plurality of garments on hangers in an easy and unencumbered manner with a minimum of wrinkles. The present invention fulfills such needs.

BRIEF STATEMENT OF THE INVENTION

In accordance with the invention there is provided a garment supporting system comprising in combination at least one garment supporting means provided with a hooklike neck having an aperture located therein and an elongated flexible tie having a less flexible segment located along the length thereof, gripping means disposed on one end and means located near the opposite end of the tie for passage of the gripping means and the elongated flexible portion thereof adjacent thereto through the tie, the tie being disposed through the aperture in the garment supporting means, the gripping means and the elongated flexible portion of the tie being passed through the means for passage therethrough and the garment supporting means being supported on the less flexible segment of the tie, whereby a garment supported on the garment supporting means is transportable with greater ease and control by a user.

THE DRAWINGS

In order to understand the present invention more fully, reference is directed to the accompanying Drawings illustrating the invention and in which Drawings.

Figure 7:
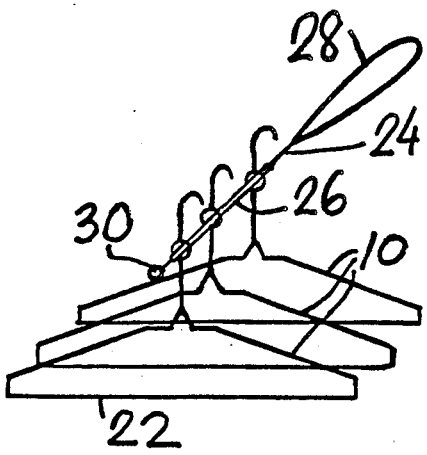
FIG. 7 is an illustration of a plurality of garment support means supported on a less flexible segment employing a tie such as that illustrated in FIG. 2 in combination with such garment supporting means.
Figure 2:
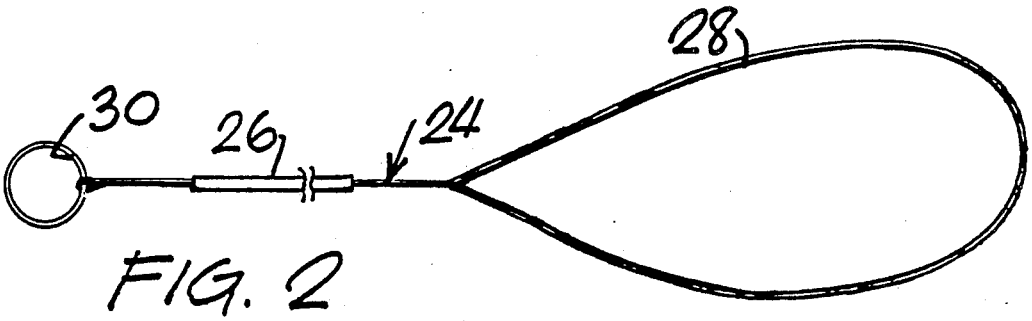
FIG. 2 is a plan view of a tie employed in combination with the garment supporting means of FIG. 1 and illustrating an elongated flexible tie having a less flexible segment located the length thereof, a large flexible ring located on one end thereof and a smaller flexible ring located on the opposite end thereof for passage therethrough of the gripping means.

FIG. 8 is a partial enlarged view of the arrangement shown in FIG. 7 illustrating how the gripping means of the tie of FIG. 2 is looped through the flexible ring on the end of the tie opposite the gripping means; and FIG. 9 is a partial view in perspective and partially in section showing an individual carrying a bundle of clothes employing a tie such as that illustrated in FIG. 2 and how the bundle rests flat against the carrier's back, as well as how the collars of the garments in the bundle are unaffected by the tie which is passed through the apertures of the hangers and is looped through the small ring.

DESCRIPTION OF THE PREFERRED EMBODIMENTS

Figure 1:
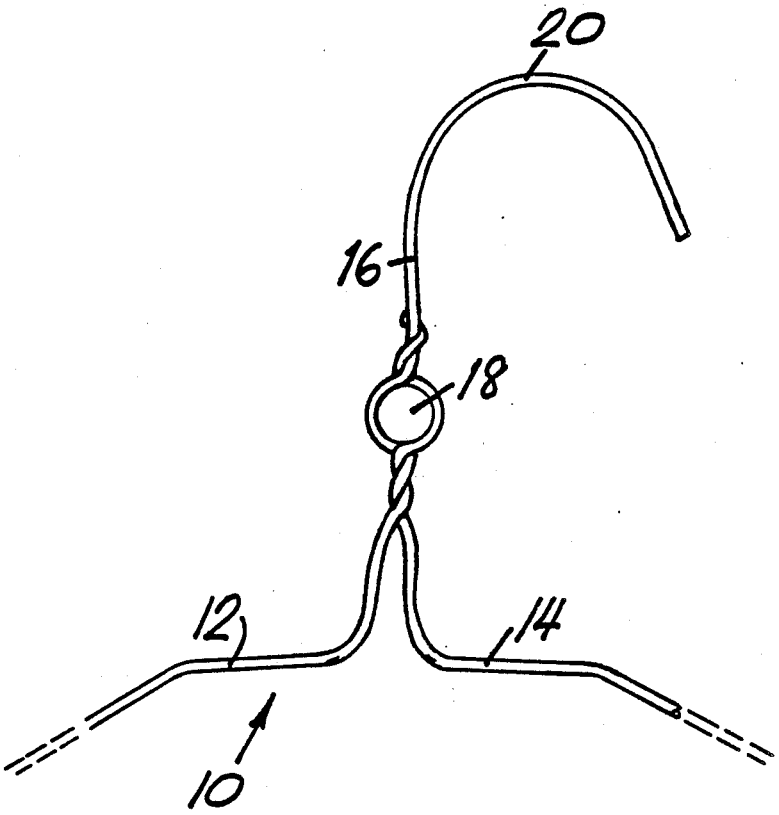
FIG. 1 is a partial front view of a garment supporting means in accordance with the invention employed in combination with a tie and illustrating the aperture in the hooklike neck thereof through which the tie is passed.

Referring now more particularly to FIG. 1, there is partially shown there a garment supporting means 10 provided with arms 12 and 14 and a hooklike neck 16 having a circular aperture 18 located therein and terminating in a hooklike portion 20. If desirable, arms 12 and 14 may be joined by a cross bar 22, as illustrated in FIG. 8, although bar 22 may omitted, if desirable, as shown in FIG. 1. It is to be understood that while the garment supporting means 10 may be made from relatively rigid metallic wire, such as in the well-known garment supporting hangers, it may also be made of plastics material, such as molded polyethylene, nylon, polyurethane and other similar plastics and the like.

In constructing the garment supporting system of this invention, the described garment supporting means 10 is employed in combination with a tie such as that illustrated in FIGS. 2 through 5 and which is provided with a less flexible segment, as described more fully hereinafter.

More specifically, as may be seen from reference to FIG. 2, a suitable tie in accordance with this invention to be employed in combination with the garment supporting means illustrated in FIG. 1 comprising an elongated flexible tie 24 having a less flexible segment 26 located along the length thereof. Gripping means, such as flexible ring 28 are disposed on one end of the flexible tie 24 and means are located near the opposite end, such as flexible ring 30 for passage of the gripping means and the elongated flexible portion of the tie adjacent thereto therethrough. Tie 24, as well as the other ties illustrated in the Drawings, may be made from a wide variety of materials, or combinations thereof, such as flexible metallic wire, leather, plastics materials or non-plastics materials such as paper, string or rope. It is preferably made of plastics materials, such as molded polyethylene, nylon, polyurethane and similar plastics materials and the like.

In employing the described garment supporting means and tie in combination to form the garment supporting system of this invention, one or a plurality of garment supporting means are disposed on the less flexible segment 26 of the tie and ring 28 along with the elongated flexible portion of the tie adjacent thereto are passed through flexible ring 30. Such disposition of the tie and the garment supporting means retains the garment supporting means on the less flexible segment of the tie and a user may grip the ring 28 with ease in order to transport the so assembled system with the garment supporting means retained on the tie at the less flexible portion thereof. Moreover, when a plurality of gripping means are so disposed on the tie, including garments supported on the garment supporting means or hanger, the garments due to their bulk tend to maintain their positions on the less flexible portion of the tie so as not to slide, whereby the bulk and weight of garments is more evenly distributed on the tie and they are held in place thereon and are easier to control and transport by a user carrying the system.

It is to be understood that it is within the purview of this invention that the less flexible portion of the tie can simply be a thickened area and it may be made from the same material or different material. Furthermore, it may be a generally circular tubularlike element through which the tie is simply passed or it may actually be a thickened portion of the material from which the tie is made.

Figure 6:
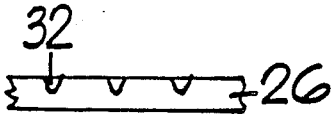
FIG. 6 is a partial lateral view of a less flexible segment of a tie provided with grooves in which the apertures of garment support means are located when such means are disposed thereof.

Still further, if desirable, the less flexible portion can be provided with grooves 32, such as illustrated in FIG. 6.

Figure 3:
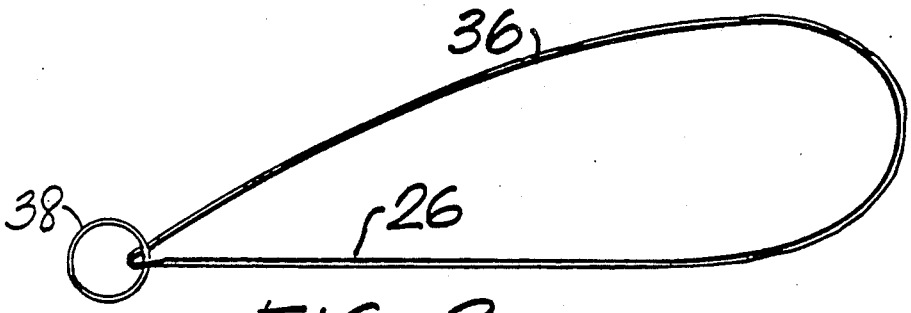
FIG. 3 is a variation of the embodiment illustrated in FIG. 2 wherein the tie is made of a large flexible ring having a less flexible segment located thereon and which ring acts as the gripping means and has disposed thereon a small ring through which the large ring is passed when garment supporting means are supported on the less flexible portion thereof.

Referring now more particularly to FIG. 3, the variation of the embodiment of the tie shown their includes a continuous flexible ring 36 having a less flexible segment 26. Ring 36 not only functions as elongatable flexible tie and the less flexible segment thereof but also forms the gripping means and for this purpose the smaller flexible ring 38 forms the means located near the opposite end for the passage of the gripping means and elongated flexible portion of the tie therethrough. In actual use the garment supporting means are disposed on the less flexible portion of ring 36 by passing ring 36 through the aperture located on one or more garment supporting means. Then, the remaining flexible portion of ring 36 is passed through ring 38 to form an operative system in accordance with the invention.

This particular tie construction is illustrative of a tie embodying two interlocking pieces, in accordance with the invention, as opposed to the one piece system illustrated in FIG. 2.

Figure 4:
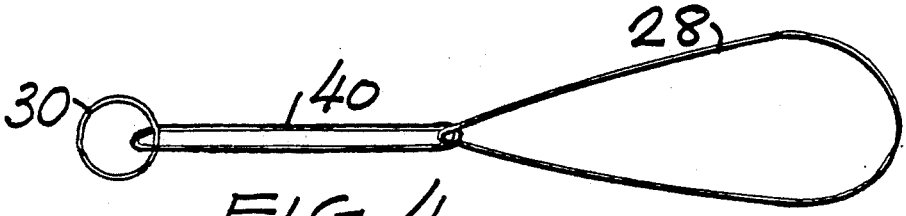
FIG. 4 illustrates another embodiment of the tie illustrated in FIG. 2 having a less flexible central ring on which are disposed a large flexible ring and a small flexible ring.
Figure 5:
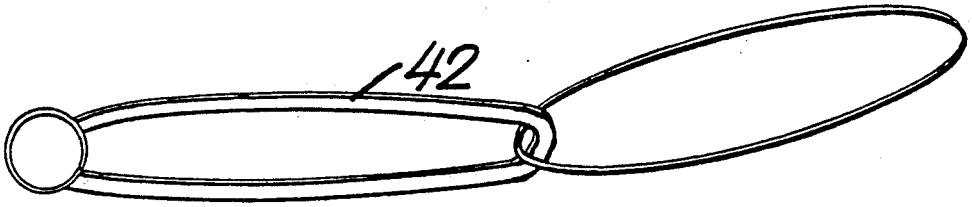
FIG. 5 is a further illustration of a modification of the tie shown in FIG. 2 which comprises a central flat ribbonlike less flexible ring having disposed thereon a large flexible gripping ring and a small ring for passage therethrough of the large flexible ring when garments are disposed on the flat ribbonlike ring.

In addition to the above described embodiments of a system, in accordance with the invention, a further variation of the system utilizes three interlocking pieces to form the tie, as illustrated in FIGS. 4 and 5. Such embodiments comprise a less flexible ring segment 40 having disposed thereon a flexible ring 28 which forms the gripping means and a smaller ring 30 through which the gripping means or ring 28 is passed when garment support means are disposed on the less flexible ring 40.

As illustrated in FIG. 5, the less flexible segment of the tie can be a flat ribbonlike segment 42, this arrangement, otherwise, being like that illustrated in FIG. 4. Moreover, it is to be understood that in the embodiments illustrated in FIGS. 3, 4 and 5, the less flexible segment or ring can be provided with grooves such as grooves 32, shown in FIG. 6.

Referring now to FIG. 7, a tie such as that illustrated in FIG. 2, is employed to form a system with a plurality of garment support means. As illustrated there, the garment support means are disposed on the less flexible portion of the tie and ring 28 is simply passed through ring 30 to provide a system which allows a user to transport a plurality of garments disposed on the garment support means or hangers while keeping them separated from each other, thus allowing greater ease and facility in transporting the system, as well as ease of control by a user of the system in transporting the same, as shown in greater detail in FIG. 8.

Next, referring to FIG. 9, a system according to the invention is shown being carried by an individual with the bundle of garments 42, 44 and 46, such as, for example, shirts 48, 50 and 52 disposed on garment supporting means 10 provided with a hooklike neck 16 having a circular aperture 18 located therein and terminating in a hooklike portion 20. The garments are covered by plastic envelopes 54, 56 and 58, such as those generally provided by cleaning and laundering establishments. As seen in FIG. 9, the collars 60, 62 and 64 of the shirts, since the shirts are held apart from each other during transportation, remain substantially free of wrinkles. Moreover, the bundle of garments rests substantially flat against the back of the carrier, thus allowing the individual carrying the same to do so with facility, ease and comfort.

The system of this invention provides numerous advantages in addition to those previously mentioned hereinabove. For example, the elements of the system can be made from a wide variety of readily available and relatively inexpensive raw materials. Moreover, the garment support means, as well as the tie, no matter what its particular construction is, in accordance with above-described embodiments, can be readily manufactured in a simple manner without complex machinery and apparatus. Still further, the various elements of the system of this invention can be used repetitively. On the other hand, they are so simply and cheaply manufactured, that cleaning establishments can stock the same at a minimum of expense and, if desirable, a user may actually dispose of the elements of the system, even if they have only been used once. In addition, the system of this invention permits a person to carry a plurality of garments on hangers in an easy, unencumbered and comfortable manner while at the same time permitting the garments to remain substantially free of wrinkles.

Numerous other advantages of the system of this invention will be readily apparent to those skilled in the art. It is to be understood, therefore, that numerous variations of the described embodiments of this invention may be made without departing from the spirit and scope thereof. It is to be understood, therefore, that this invention is not to be limited to the embodiments described above except as defined in the appended Claims.

What is claimed is:

1. A garment supporting system comprising in combination at least one garment supporting means provided with a hooklike neck having an aperture located therein and an elongated flexible tie having a less flexible segment located along the length thereof, gripping means disposed on one end and means located near the opposite end for passage of said gripping means and the elongated flexible portion of said tie adjacent thereto therethrough, said tie being disposed through the aperture in said garment supporting means, said gripping means and said elongated flexible portion of said tie being passed through the means for passage therethrough and said garment supporting means being supported on the less flexible segment of said tie, whereby a garment supported on said garment supporting means is transportable with greater ease and control by a user.

2. A garment supporting system according to claim 1 including a plurality of garment supporting means supported on the less flexible segment of the tie, whereby a plurality of garments supported on said garment supporting means are transportable with greater ease and control by a user.

3. A garment supporting system according to claim 1 wherein the tie is made of plastic.

4. A garment supporting system according to claim 3 wherein the tie is made of polyethylene.

5. A garment supporting system according to claim 3 wherein the tie is made of nylon.

6. A garment supporting system according to claim 3 wherein the tie is made of polyurethane.

7. A garment supporting system according to claim 2 wherein the enlarged less flexible segment of the tie is provided with a plurality of grooves in which each garment supporting means of the plurality of garment supporting means is supported.

8. A garment supporting means according to claim 1 wherein the garment supporting means is a metallic garment hanger.

9. A garment supporting system according to claim 1 wherein the garment supporting means is a plastic garment hanger.

10. A garment supporting system according to claim 2 wherein the garment support means is a plurality of metallic garment hangers.

11. A garment supporting system according to claim 2 wherein the garment supporting means is a plurality of plastic garment hangers.

12. A garment supporting system according to claim 1 wherein the tie comprises a flat ribbonlike, less flexible segment having elongated flexible portions extending from the opposite ends thereof with the gripping means located on the end of one of said portions and the means for passage of said gripping means located on the opposite end of the other portion.

13. A garment supporting system according to claim 12 wherein the gripping means and the means for passage of the gripping means therethrough are rings, the ring forming the gripping means being at least as large as the ring forming the means for passage of the gripping means.

14. A garment supporting system according to claim 12 wherein the flat, ribbonlike, less flexible segment is provided with a plurality of opening through the surface thereof for reception therethrough of the hooklike neck of the garment supporting means.

15. A garment supporting system according to claim 1 wherein the tie comprises a less flexible ring segment having two flexible ring segments disposed thereon, one of said ring segments being longer than the other.

16. A garment supporting system according to claim 1 wherein the tie comprises a elongated flexible member having a less flexible segment located along the length thereof and having ring segments disposed at opposite end thereof, one of said ring segments being longer than the other.

17. A garment supporting system according to claim 1 wherein the tie comprises two continuous flexible ring segments, one of said ring segments being longer than the other and including a less flexible segment disposed thereon and the other ring segment being disposed on the larger ring segment.

* * * * *